United States Patent [19]

Funk

[11] Patent Number: 4,477,166

[45] Date of Patent: Oct. 16, 1984

[54] DIAZO PRINTER WITH IMPROVED AMMONIA SUPPLY SYSTEM

[75] Inventor: Roger S. Funk, Holicong, Pa.

[73] Assignee: R. Funk and Co., Inc., Doylestown, Pa.

[21] Appl. No.: 444,492

[22] Filed: Nov. 24, 1982

[51] Int. Cl.[3] ..... G03D 7/00

[52] U.S. Cl. ..... 354/300; 354/319

[58] Field of Search ..... 354/298, 300, 319; 355/27, 100

[56] References Cited

U.S. PATENT DOCUMENTS

| | | | |
|---|---|---|---|
| Re. 26,525 | 2/1969 | Wilde et al. | 354/300 |
| 3,147,687 | 9/1964 | Halden | 354/300 |
| 3,915,708 | 10/1975 | Zausmer et al. | 354/300 |
| 4,122,474 | 10/1978 | Songer et al. | 354/300 |
| 4,319,826 | 3/1982 | Bussche et al. | 354/300 |

*Primary Examiner*—A. A. Mathews

*Attorney, Agent, or Firm*—Albert L. Free

[57] ABSTRACT

The speed of a diazo printer is sensed and the rate of ammonia delivery to the developer chamber is automatically boosted at higher printer speeds. Preferably, a sensor positioned adjacent a rotary paper-drive member produces electrical pulses at a rate proportioned to the speed with which the copy paper passes through the developer chamber, and an electronic circuit board contains circuitry which senses when the rate of recurrence of these pulses rises into a predetermined range; when this occurs, the circuitry causes a solenoid valve to deliver an ammonia boost directly to a perforated tube located within the perforated tube through which the normal ammonia supply takes place at lower speeds.

4 Claims, 4 Drawing Figures

HOT AMMONIA VAPOR
FLOW METER
BOOST VALVE
COLD ANHYDROUS AMMONIA FROM BOOST VALVE
PUMP
WATER
10
12
15
16
18
20
22
24
24a
24b
26
27
28
28d
31
42
44
46
62
64
66

DIAZO PRINTER WITH IMPROVED AMMONIA SUPPLY SYSTEM

REFERENCE TO RELATED PATENT APPLICATIONS

U.S. patent application Ser. No. 375,654, filed May 6, 1982 and entitled Improved Diazo printer, filed by Roger S. Funk, describes a form of diazo printer to which the present application is applicable, and describes and claims a water-control system for such printer which may be, but is not necessarily, used with the ammonia supply system of the present invention.

BACKGROUND OF THE INVENTION

Diazo printers have been known for many years, and are especially effective for producing high-accuracy whiteprints from original materials to be printed. In such printers, a sheet of printing paper and an overlying sheet of original material to be printed are conveyed by a motor-driven roller system through a position in which they are exposed to ultra-violet radiation from a suitable ultra-violet lamp, after which the original document and the copy paper are separated from each other; the original is returned to the machine user, while the copy paper is moved, again by the motor-driven roller system, through a developer chamber in which it is exposed to a mixture of ammonia and water vapor. Upon exit from the developing chamber, the copy paper carries an accurate reproduction of the information contained upon the original copy.

In order to obtain proper image reproduction, it is important that the ammonia be delivered to the developer chamber at a sufficiently high rate. The minimum rate of delivery of ammonia to the developer chamber which produces satisfactory results increases with the speed at which the copy paper is moved through the developer chamber. It is possible to set the rate of ammonia delivery at a fixed value which is adequate for any contemplated speed of the copy paper, but if this fixed rate of delivery is set high enough for the higher range of speeds of the copy paper then it is excessive for speeds of the copy paper in a lower range. Not only would such an adjustment waste ammonia, but some of the excess ammonia may be discharged to the room, where it would be highly objectionable, or special expensive provision would have to be made for its removal.

It has therefore been common in the past to set the ammonia delivery rate at a first relatively lower value when the copy paper speed is in a lower range of speeds, e.g. 0–40 feet per minute, and to adjust it manually to higher levels if higher copy speeds are utilized, e.g. 40–60 ft./min. This not only requires an operator to make such adjustments in ammonia delivery rate, but as a practical matter often results in pollution of the room with excess ammonia vapor when the speed of the copy paper is decreased and the operator forgets or otherwise fails to turn down the ammonia delivery rate.

Accordingly, it is an object of the invention to provide a new and useful ammonia supply system which assures that the ammonia delivery rate will be increased appropriately when the copy paper speed increases into a higher range of speed, and which assures that the ammonia delivery rate will be cut back or reduced when the speed of the copy paper through the developer chamber is reduced into a lower range.

A further object is to provide such a system which does not require careful monitoring by an operator, and in fact does not require an operator to adjust the ammonia delivery rate at all.

SUMMARY OF THE INVENTION

These and other objects of the invention are achieved by the provision of apparatus for producing a controlled rate of supply of ammonia to the developer chamber of a diazo printer, comprising speed-determining means for determining the speed of movement of copy paper through the chamber, and electronic control means responsive to changes in the speed-determining means for controlling the rate of supply of ammonia to said developer chamber to increase such rate of supply when the speed of movement of the copy paper increases, and to decrease the rate of supply of ammonia when the copy paper speed decreases.

In a preferred embodiment, transducer means are employed which respond to operation of a rotary drive member for moving the copy paper through the developer chamber to produce a train of electrical pulses having a repetition rate proportional to the speed of the rotary drive member; electronic circuit means are preferably employed which are responsive to this train of electrical pulses to produce a control signal indicative of whether the repetition rate of the pulses is in a first low range corresponding to a first low range of speeds of the rotary drive member, or in a second higher range corresponding to a second higher range of speeds of the rotary drive member. Conduit means are provided for supplying a flow of ammonia to the developer chamber, this conduit means comprising electrically-controlled valve means responsive to a control signal representative of copy paper speed to increase the rate of flow of ammonia through the conduit to the developer chamber when the control signal indicates that the repetition rate of the pulses is in the second high range, and to decrease this ammonia flow rate when the control signal indicates that the repetition rate is in the first lower range.

Also, in a preferred embodiment, the ammonia supply system includes a first conduit system for supplying ammonia to the developer chamber at a relatively low rate suitable for copy paper speeds in said lower range of speeds, and additional conduit means for feeding the developer chamber with a "boost" flow of ammonia which is controlled by valve means actuated to an on or an off condition depending upon whether the electronic circuitry indicates that the copy paper speed is above or below a predetermined value. Accordingly, the rate of ammonia delivered to the developer chamber is automatically given a boost whenever the speed of the copy paper rises to a value which requires such additional ammonia for proper image development, and automatically falls to a suitable lower level when the speed of the copy paper falls back to a lower speed for which such additional ammonia is not required. Preferably, the boost ammonia is released into the developer chamber by way of a tube having apertures in its sidewalls, positioned within an outer tube also having apertures in its sidewalls, to which outer tube the normal flow of ammonia is supplied.

BRIEF DESCRIPTION OF FIGURES

These and other objects and features of the invention will be more readily understood from a consideration of the following detailed description, taken in connection with the accompanying drawings, in which.

DETAILED DESCRIPTION OF PREFERRED EMBODIMENTS

Figure 1:
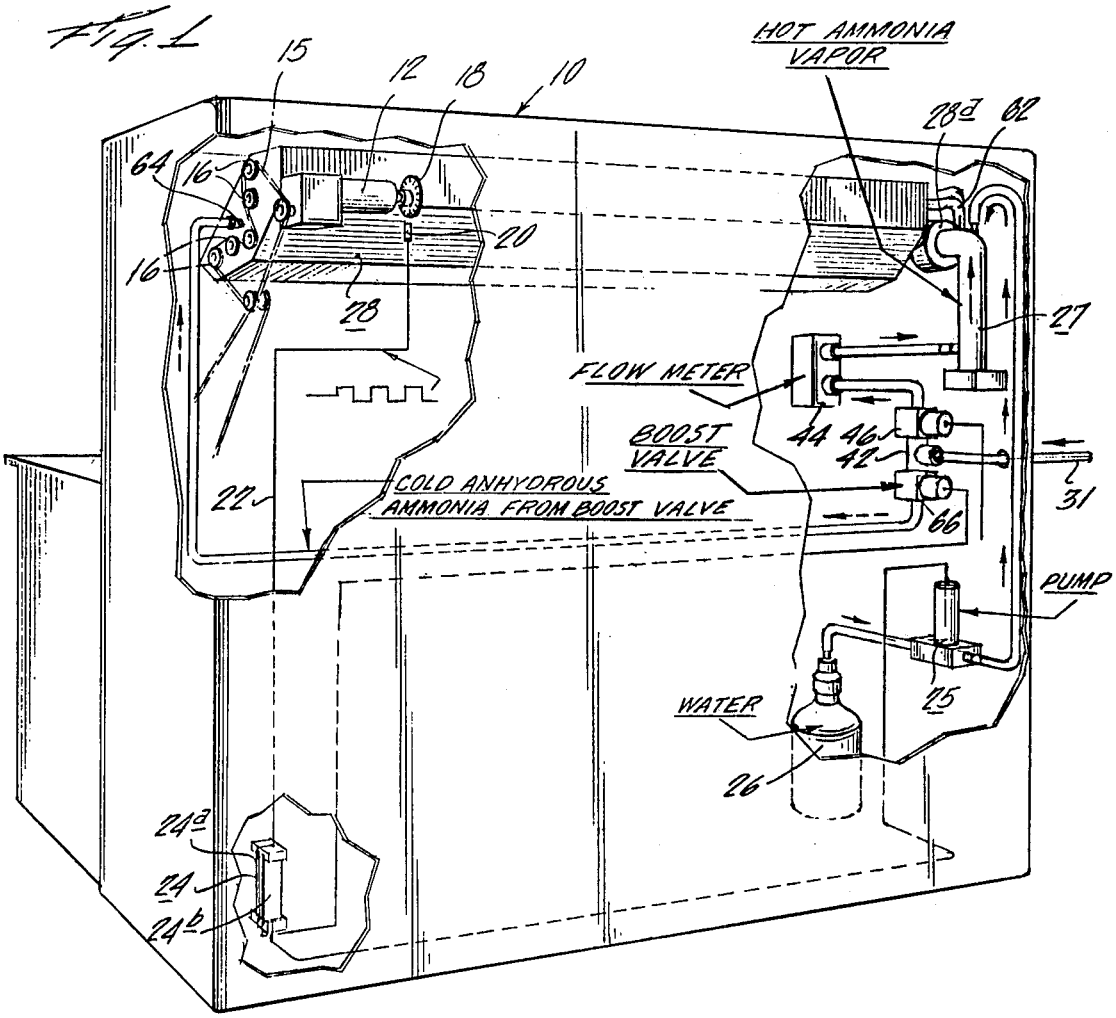
FIG. 1 is a perspective view with parts broken away showing diagrammatically the overall arrangement of a diazo printer including apparatus in accordance with the invention.

Referring now to FIG. 1, there is shown a form of diazo printer embodying the preferred embodiment of the invention. Most of the overall arrangement of the printer is like that shown and described in my copending U.S. patent application Ser. No. 375,654, entitled Improved Diazo Printer and filed May 6, 1982, and the description therein of such similar portions of the printer is included herein by reference. The portions which have been added according to the present invention comprise an ammonia-boost circuit board and a solenoid-controlled valve and ammonia-boost conduit arrangement for supplying the boost ammonia to the developer chamber and releasing it therein, as described later herein.

More particularly, the diazo printer 10 includes a drive motor 12 which drives the developer rollers 14 to convey the printing paper through the machine, by means of an appropriate drive chain 15 and sprockets such as 16. A steel timing gear 18, driven by motor 12, turns at the motor speed, or, if driven through intermediate gears, at a different speed bearing a known relationship to motor speed. An electromechanical transducer in the form of a reluctance pick-up 20 is positioned adjacent the periphery of gear 18, so that each time a tooth of gear 18 passes reluctance pick-up 20, an electrical pulse is induced in line 22 extending from the transducer to the printer-control circuit board assembly 24. Other forms of pick-up devices known in the art may be utilized, for example a photocell-light source pick-up, the effect of its operation in any event being to produce on line 22 a train of generally rectangular pulses at a repetition rate proportional to the rotational speed of the motor 12.

It is the function of the electrical system embodied in circuit board 24A to receive this train of pulses from the pick-up 20 and to derive therefrom a corresponding train of pump-actuating pulses occurring at a repetition rate which is an integral submultiple of the repetition rate of the train of pulses from the electromechanical transducer, and to apply the latter divided-down pump-actuating pulses to the solenoid pump 25 so as to pump water from water source 26 to water evaporator 27 at a rate proportional to the repetition rate of the divided-down pump-actuating pulses. The evaporator, suitably heated, receives the pumped water, and ammonia gas from line 31, and delivers the resultant mixture of ammonia and water vapor to the developer chamber 28, with the aid of a blower 28A.

The details of the purpose, structure and operation of this water-control system are set forth in detail in the above-cited copending application, and need not be set forth herein, except to point out that it is optional whether or not one uses this automatic water supply and control system with the ammonia control system of the present invention.

Figure 2:
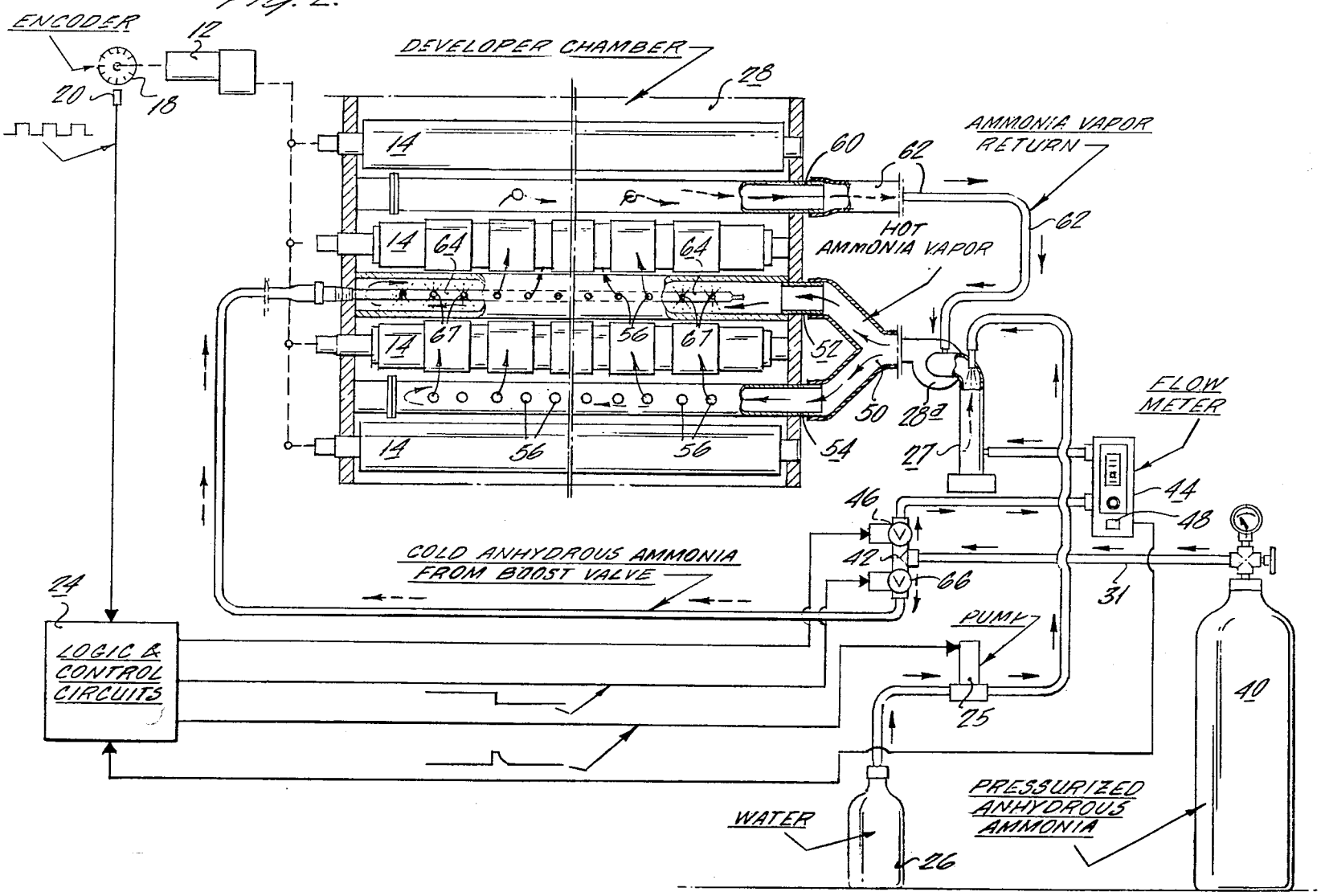
FIG. 2 is a schematic diagram of the system of the invention, in which the developer chamber and contents are shown in a schematic development view.

Referring now especially to FIG. 2, the ammonia source 40 in the form of a large bottle of pressurized anhydrous ammonia supplies ammonia over line 31 to T-junction 42, whence it flows through a commercial adjustable flowmeter 44 to the evaporator 27, so long as the "normal" ammonia solenoid valve 46 is open under the control of front-panel push-button 48. This "normal" flow of ammonia, mixed with water vapor, flows through blower 28A and Y-connection 50 to the inlet ends of tubes 52 and 54 in the developer chamber; each of these latter tubes has a plurality of apertures such as 56 along and through its sidewalls, and the normal flow of ammonia and water vapor passes through these apertures into the developer chamber and over the surfaces of the copy paper to be developed. An exhaust tube 60 is also disposed in the developer chamber; this tube has apertures in its sidewalls through which the exhaust ammonia vapor may return, via return line 62, to the suction side of the blower 28A.

Circuit board 24B contains circuitry for controlling solenoid valve 66. When the copy paper speed is in its lower range, e.g. below about 40 ft./min., solenoid valve 66 remains closed and the above-described "normal" ammonia flow is the only flow of ammonia to the developer chamber. However, when the copy speed is in the higher range, e.g. above about 40 ft./min., the circuitry on board 24B turns on valve 66, causing an additional flow of "boost" ammonia to be delivered from source 40 over line 31 to the interior of boost-dispensing pipe 64. The latter pipe, in this example, is concentrically mounted inside pipe 52, and has apertures such as 67 in its sidewalls so that the "boost" ammonia can travel through the latter apertures and mix with the "normal" ammonia flow in the surrounding larger tube 52.

In a typical example, the normal flow rate of ammonia plus water vapor may be about 5.5 cfh, and the additional or "boost" flow rate of ammonia about 3 to 6 cfh. Preferably the valve controlling the flow of boost ammonia is a manually-adjustable needle valve, so that the magnitude of boost ammonia flow can be set to suit the requirements of any particular diazo machine.

Figure 4:
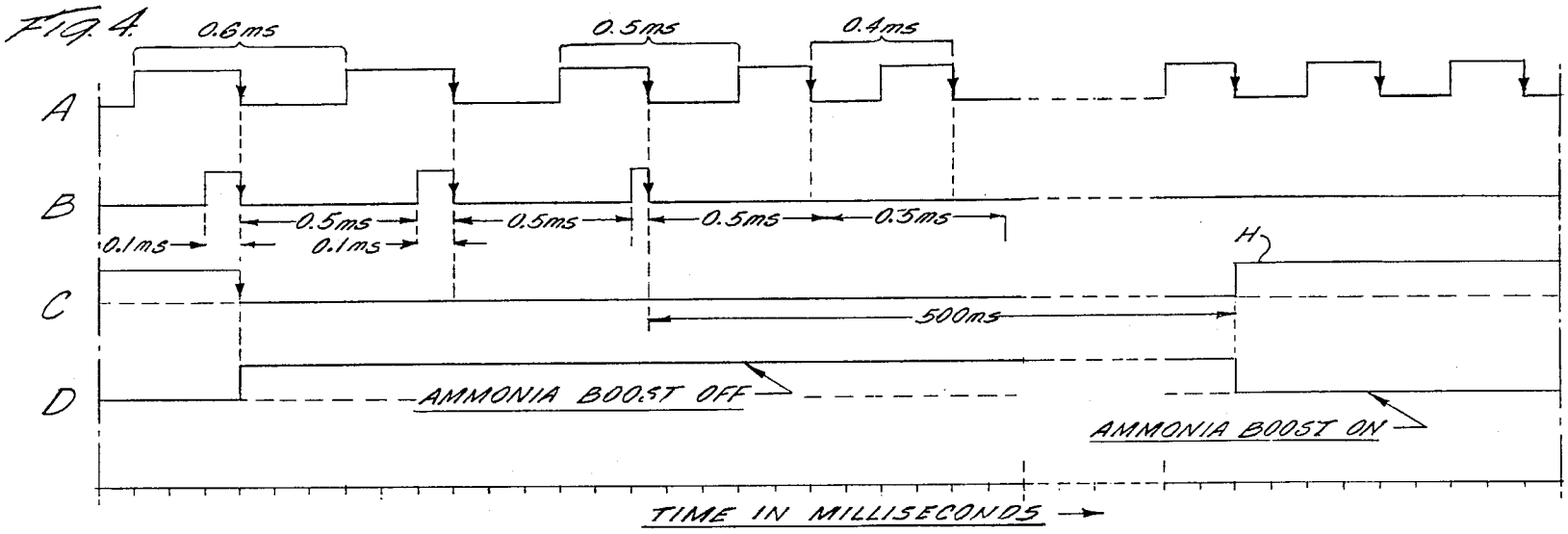
FIG. 4 is a set of four idealized waveforms to a common time scale, to which reference will be made in describing the operation of the invention in a preferred form.
Figure 3:
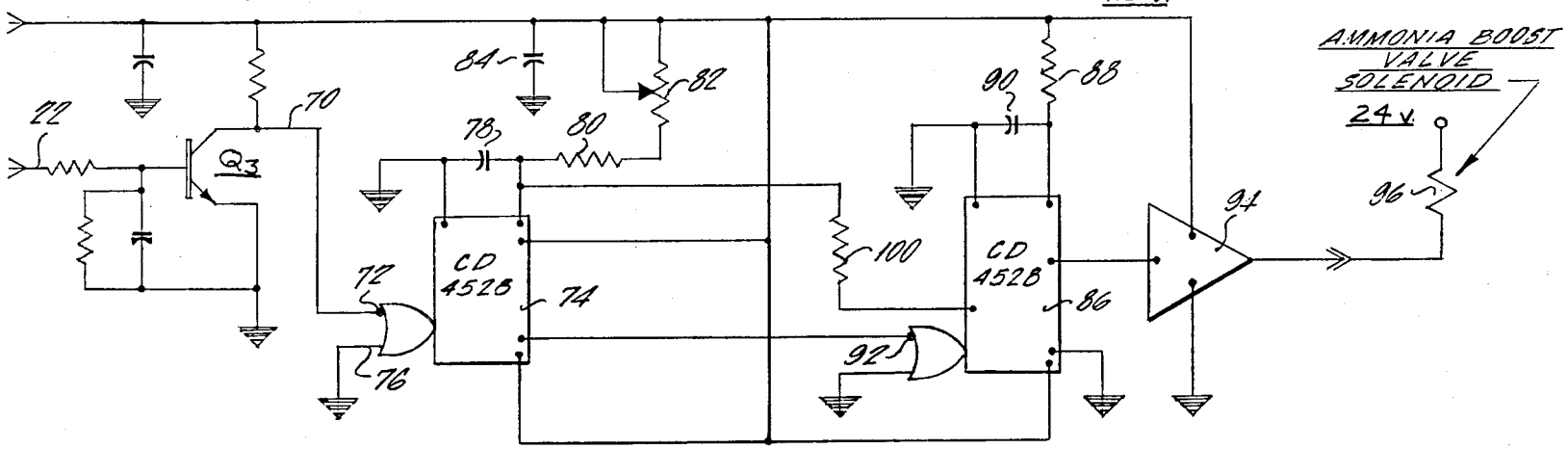
FIG. 3 is an electrical schematic diagram illustrating suitable electronic circuitry for responding to signals representing the speed of copy paper through the developer chamber to produce a control signal for controlling the times at which the ammonia boost is applied to the ammonia supply system.

Referring now to the electrical diagram and idealized waveforms of FIGS. 3 and 4 showing the construction and operation of the presently preferred embodiment of electrical circuitry for use in circuit board 24B in the system of the invention, this circuitry serves to sense when the speed of operation of the printer is in a predetermined higher range of speeds and to produce a control signal for turning on the solenoid-controlled boost valve when the printer speed is in this higher range, and to turn off the ammonia-boost valve when the printer speed is in a lower range of speeds.

More particularly, the pulses supplied over line 22 from the pick-up 20, representing the printer speed, are passed through a transistor amplifier stage $Q_3$, which serves to adjust the d-c level of these pulses from a 5-volt maximum positive value to a 12-volt maximum positive value for d-c compatibility with the rest of the circuit. In this example, the stage $Q_3$ comprises a type-2N4401 transistor in the grounded-emitter configuration; the values of the resistors and capacitors may be as follows: $R_1=39K$, $R_2=3.9K$. $C_1=0.01$ μf, $R_3=10K$, $C_2=0.01$ μf.

The resultant pulses on the collector output line 70 of $Q_3$ may therefore be as shown at A in FIG. 4. These pulses have a repetition rate which varies in proportion to the speed of the rotating drive member of motor 12 and hence in proportion to the speed of the copy paper through the printer. For purposes of illustration, in FIG. 4A the pulse repetition period is assumed to be initially 0.6 milliseconds, corresponding to a repetition rate or pulse frequency of about 1667 p.p.s.; as the printer speeds up, the pulse repetition period changes to 0.5 millisecond with a pulse frequency of about 2,000 p.p.s., and then to a repetition period of 0.4 milliseconds with a pulse frequency of 2,500 p.p.s. Typically each pulse may represent about 0.004" of travel of the copy paper through the printer, so that the pulse frequencies of 1667 p.p.s., 2,000 p.p.s. and 2,500 p.p.s. correspond to about 33 ft/min., 40 ft/min. and 50 ft/min., respectively.

The pulses on line 70 are applied to input terminal 72 of retriggerable monostable multivibrator 74 of conventional commercial form, the other input terminal 76 of which is grounded. The width of output pulses from the multivibrator is determined principally by the time constant due to the capacitance of capacitor 78 and the total resistance of fixed resistor 80 and variable resistor 82, connected as shown; typical circuit values are as follows: resistor 82=0–10K, resistor 80=1.5K, capacitor 78=1.0 μf, capacitor 84=0.01 μf. The multivibrator device may comprise a commercially-available type CD 4528 integrated circuit device. It is retriggerable in the sense that if it at any time it has been triggered to its Low output state by a negative-going edge of a pulse at its input terminal, and another negative-going edge of a pulse is thereafter applied to its input terminal before it reverts to its High state, then it will remain in its Low state for an additional time equal to its normal output pulse width and then revert to its High state, unless before that time another negative-going pulse transition occurs. Accordingly, input trigger pulses recurrent at time intervals shorter than the natural pulse width of the multivibrator will hold its output continuously in its Low state.

This action is illustrated at A and B of FIG. 4, wherein it is seen that the negative-going transitions, indicated in waveform A by arrowheads, trigger the multivibrator to the Low states shown in waveform B when the repetition period of the input pulses is 0.6 milliseconds; here it is assumed that the multivibrator "times out" in about 0.5 milliseconds, so that it has already reverted to its High state before the next subsequent negative-going triggering transition occurs. However, when the repetition period of the input pulses decreases below 0.5 milliseconds, to 0.4 milliseconds for example (i.e. when the copy paper speed increases above about 40 feet/min. to about 50 ft/min. for example), the negative-going transitions recur in less than the 0.5 millisecond time-out period of the multivibrator and therefore hold the multivibrator in its Low state as shown, so that no pulses appear at the output of the multivibrator. If the copy speed later decreases so that the input pulse repetition period is again 0.6 milliseconds and the pulse frequency about 1,667 p.p.s., the previously-described conditions recur and the pulses reappear in the multivibrator output. The multivibrator output pulse duration, and hence the copy paper speed at which the transition from output pulses to no output pulses occurs, can be adjusted over a limited range by manual adjustment of variable resistor 82.

The circuit also uses a second retriggerable multivibrator 86, which may comprise the same type CD 4528 integrated circuit device as does the first multivibrator 74, but with a much larger value of time-constant resistor 88, so that the "time out" interval, or output pulse width, is many times greater than for the first multivibrator, e.g. may be about 500 milliseconds. Using a value for capacitor 90 of 1 μf, the 500-millisecond time-out can be obtained with a resistor 88 having a resistance of about 470K. The output pulses of the first multivibrator 74 are applied to the input terminal 92 of the second multivibrator 86 to trigger it.

As shown at C of FIG. 4, the output of second retriggerable multivibrator 86 therefore will be triggered from its High state to its Low state by any negative-going transition of the output pulses of the first multivibrator shown at B of FIG. 4. Since the repetition period of the encoder pulses is always shorter than the 500 millisecond time-out interval of the second multivibrator, second multivibrator 86 will remain in its Low state so long as the first multivibrator is producing output pulses, but will revert to its High state about 500 m.s. after the output pulses of the first multivibrator disappear due to high copy-paper speeds; such a High state is shown, for example, at H of waveform C of FIG. 4, and occurs only when the copy paper speed is in the higher range—e.g. above about 40 ft./min.

The output of second multivibrator 86 is passed through a buffer amplifier 94 to generate appropriate signal power for operating ammonia-boost solenoid valve 66, the solenoid coil of which is designated 96 in FIG. 3. In this example, buffer 94 reverses the polarity of the levels applied to it, so that its output level is as shown at D of FIG. 4, i.e. it is turned ON and assumes its Low state to draw current through solenois coil 96 from the 24-volt supply source only when the copy paper speed is in the high range of speeds, in this example above about 40 ft./min., at which times it turns on the ammonia boost valve as desired.

Ideally, there would be a single critical copy paper speed and corresponding encoder pulse rate above which the pulses from the first multivibrator shown in FIG. 3 would disappear, and below which these pulses would reappear. However, in reality there is typically a narrow range of transition speeds within which these pulses may appear and disappear randomly and for which the ammonia boost valve may tend to chatter or "hunt". To avoid this, it is preferred to employ the feedback resistor 100, having a value in this example of about 220K, connected between the two multivibrators 74 and 86 to introduce a small amount of hysteresis so that the second multivibrator 86 will tend to stay in its High state until the copy paper speed falls slightly below the transition range of speeds and to remain in its Low state until the copy paper speed rises slightly above the transition range.

In other embodiments of the invention, it is contemplated that the ammonia flow rate may be controlled in proportion to the copy paper speed, rather than between two or more discrete levels.

While the invention has been described with particular reference to specific embodiments in the interest of complete definiteness, it will be understoond that it may be embodied in a variety of forms diverse from those specifically shown and described, without departing from the spirit and scope of the invention as defined by the appended claims.

What is claimed is:

1. Apparatus for producing a controlled rate of supply of ammonia to the developer chamber of a diazo printer which includes a variable-speed rotary drive member for moving the copy paper through the developer chamber of the printer, at a variable speed, said rotary drive member varying in speed between a first low range of speeds and a second high range of speeds, said apparatus comprising:

transducer means responsive to operation of said rotary drive member for producing a train of electrical pulses having a repetition rate proportional to the speed of said rotary drive member;

electronic circuit means responsive to said train of electrical pulses for producing a control signal indicative of whether said repetition rate is in a first low range corresponding to said first low range of speeds of said rotary drive member or in a second high range corresponding to said second high range of speeds of said rotary drive member;

conduit means for supplying a flow of ammonia to said developer chamber of said last-named means, comprising electrically-controlled valve means responsive to said control signal for increasing the rate of flow of ammonia to said developer chamber when said control signal indicates that said repetition rate is in said second high range and for decreasing said ammonia flow rate when said control signal indicates that said repetition rate is in said first low range.

2. The apparatus of claim 1, wherein said conduit means comprises first conduit means for supplying ammonia to said developer chamber whether said speed of said rotary drive member is in said first low range or in said second high range, and second conduit means for supplying additional ammonia to said developer chamber at a rate controlled by said valve.

3. The apparatus of claim 1, wherein said electronic circuit means comprises means for producing a first level of said control signal when said repetition rate is below a predetermined rate and a second level of said control signal when said repetition rate is above a predetermined rate, said valve means responding to said first level of said control signal to remain in a closed position so as to prevent flow of ammonia through it and responding to said second level of said control signal to be switched to an open position to provide a substantial flow of ammonia through it and thus boost the rate of delivery of ammonia to said developer chamber.

4. Apparatus for supplying ammonia to the developer chamber of a diazo printer, comprising:

a source of anhydrous ammonia;

a plurality of dispensing tubes in said developer chamber, having apertures through the sidewalls thereof;

means for mixing said ammonia with water vapor and for supplying the resultant mixture to said tubes through the ends thereof;

a central tube in at least one of said dispensing tubes, and having apertures through the sidewalls thereof;

means for supplying said anhydrous ammonia to an end of said central tube to provide a boost in the amount of ammonia supplied to said developer chamber during times when the speed of operation of said printer is in a relatively higher range and for reducing said supplying when said speed is in a relatively low range;

said last-named means comprising electrically-controllable valve means, and means responsive to changes in said speed of operation of said printer for developing a control signal to operate said valve means between a more open position when said speed is in said relatively higher range and a more closed position when said speed is in said relatively lower range.

* * * * *